US005736214A

United States Patent [19]

Billarant

[11] Patent Number: 5,736,214

[45] Date of Patent: Apr. 7, 1998

[54] LAMINATED ASSEMBLY CONSTITUTED BY A WARP OR WEFT-KNITTED LOOP FABRIC ADHERED FLAT ON A SUPPORT, AND ITS MANUFACTURING METHOD

[75] Inventor: Jean-Philippe Billarant, Paris, France

[73] Assignee: Aplix, Paris, France

[21] Appl. No.: 758,596

[22] Filed: Nov. 27, 1996

[30] Foreign Application Priority Data

Nov. 29, 1995 [FR] France ..... 95 14140

[51] Int. Cl.[6] ..... A44B 18/00; B32B 3/06; B32B 7/00; B32B 31/12

[52] U.S. Cl. ..... 428/92; 66/192; 66/194; 156/148; 428/86; 428/100

[58] Field of Search ..... 66/192, 194; 156/148; 428/86, 92, 100

[56] References Cited

U.S. PATENT DOCUMENTS

| | | | |
|---|---|---|---|
| 4,677,011 | 6/1987 | Matsuda | 428/88 |
| 4,705,710 | 11/1987 | Matsuda | 428/92 |
| 5,214,942 | 6/1993 | Peake et al. | 66/194 |
| 5,267,453 | 12/1993 | Peake et al. | 66/194 |
| 5,407,722 | 4/1995 | Peake et al. | 428/92 |
| 5,503,892 | 4/1996 | Callaway | 428/100 |

FOREIGN PATENT DOCUMENTS

| | | | |
|---|---|---|---|
| A-0 284 020 | 9/1988 | European Pat. Off. | D04B 21/02 |
| A-0 517 275 | 9/1992 | European Pat. Off. | D04B 21/04 |
| A-0 583 081 | 2/1994 | European Pat. Off. | D04B 1/04 |
| A-0 682 889 | 11/1995 | European Pat. Off. | A44B 18/00 |
| A-2 632 830 | 12/1989 | France | A44B 18/00 |

*Primary Examiner*—James C. Cannon
*Attorney, Agent, or Firm*—Adams Law Firm, P.A.

[57] ABSTRACT

A laminated assembly forming the female, loop portion of a self-gripping hook-and-loop fastener. The assembly includes a light-weight, open, mechanically fragile and dimensionally unstable knitted fabric adhered in a flat condition onto a support member, the knitted fabric including interknitted warp and weft yarns, and a multitude of loops having feet cooperating with the warp and weft yarns and a pair of elongate legs extending from the feet and forming a free loop top remote from the feet. The loops are sized in relation to the spacing of the warp and weft yarns of the fabric so that at least one of the two legs of the loop intersects at least one of the warp or weft yarns in spaced-apart relation from the foot of the at least one leg so that each of the loops bears on at least one warp or weft yarn to form an overlapping zone where the loop does not adhere to the support member, thus maintaining the self-gripping ability of the loops.

10 Claims, 1 Drawing Sheet

LAMINATED ASSEMBLY CONSTITUTED BY A WARP OR WEFT-KNITTED LOOP FABRIC ADHERED FLAT ON A SUPPORT, AND ITS MANUFACTURING METHOD

TECHNICAL FIELD AND BACKGROUND OF INVENTION

The present invention relates to a laminated assembly which is constituted, on one hand, by a warp or weft-knitted fabric, comprising knitted free loops and, on another hand, by a reinforcement support or substrate, for example flexible, on which the knitted fabric is adhered.

The invention applies particularly to such an assembly which is used to make the female part of a so-called self-gripping fastener, the loops of which are intended to cooperate in a separable hooking connection relationship with complementary male members, for example hooks, filiform members with enlarged heads or the like, etc.

Cost reasons result in manufacturing a knitted fabric, the foundation or base of which is light and very open or apertured. Thus, the base may be of mechanically fragile and dimensionally instable structure, but should not sacrifice the quality of the loops which constitute the critical operative members of the female part of the self-gripping fastener. The fabric base fragility and instability involve some utilization difficulties when using this fabric, as a result of the relatively high stresses to which the base is subjected and which are generated by the action of the hooking male members on the loops.

The fabric is therefore reinforced by adhering the fabric onto a more resistant support. This support can be either an intermediary support, the laminated assembly being then secured to an article, or this article itself.

There are however some difficulties when manufacturing such a laminated assembly, because the loops also have a tendency to adhere to the support through the base, together with the warp yarns (also called wales), the weft yarns (also called courses) and the loop feet, which destroys their self-gripping ability or properties since their tops firmly lie flat against the support and therefore cannot cooperate with the male members in the desired hooking connection relationship.

SUMMARY OF THE INVENTION

The object of the invention is to remedy to this drawback and, to this effect, according to a first aspect, it concerns a laminated assembly of the above indicated kind in which the knitted free loops have feet which cooperate with the warp and weft yarns, while the remainder of each loop, which is constituted by two legs or limbs extending from the feet and by a top or apex connecting the two legs, is free. The improvement resides in the fact that the loops have a size such that, with respect to the warp and/or weft pitches, for each loop, when considered flat on the warp and weft yarns, at least one of its two legs intersects at least one warp or weft yarn at a distance from the foot associated to this leg.

Thus, in the laminated assembly according to the invention, each loop comprises at least one leg which, at a distance from its associated foot, extends beyond or bears on at least another warp and/or weft yarn so that in this overlapping zone the loop does not adhere to the support, which maintains the loop self-gripping ability.

Preferably the same applies to the two legs of each loop and yet preferably to the top of each loop which is located near the common foot of two other adjacent loops, thus overlapping also this foot and the two loop legs extending therefrom.

According to an advantageous feature the loops are oblique with respect to the general directions of the warp and/or weft yarns.

For example, the two feet of a same loop can be located on a same warp yarn, or on the contrary on different warp yarns, for example adjacent.

Also for example, the two feet of a same loop are located on weft yarns which are adjacent or not adjacent.

According to a second aspect, the invention concerns a method for manufacturing the above laminated assembly, which is characterized in that it consists in: knitting said fabric so that its loops have said size with respect to the warp and/or weft pitches; applying an adhesive on said support; and bringing into contact said fabric and said support in view of their firm junction by sticking.

BRIEF DESCRIPTION OF THE DRAWINGS

The invention will be well understood from the reading of the following disclosure with reference to the accompanying drawings which belong to the disclosure itself, and in which.

DESCRIPTION OF THE PREFERRED EMBODIMENT

Figure 1:
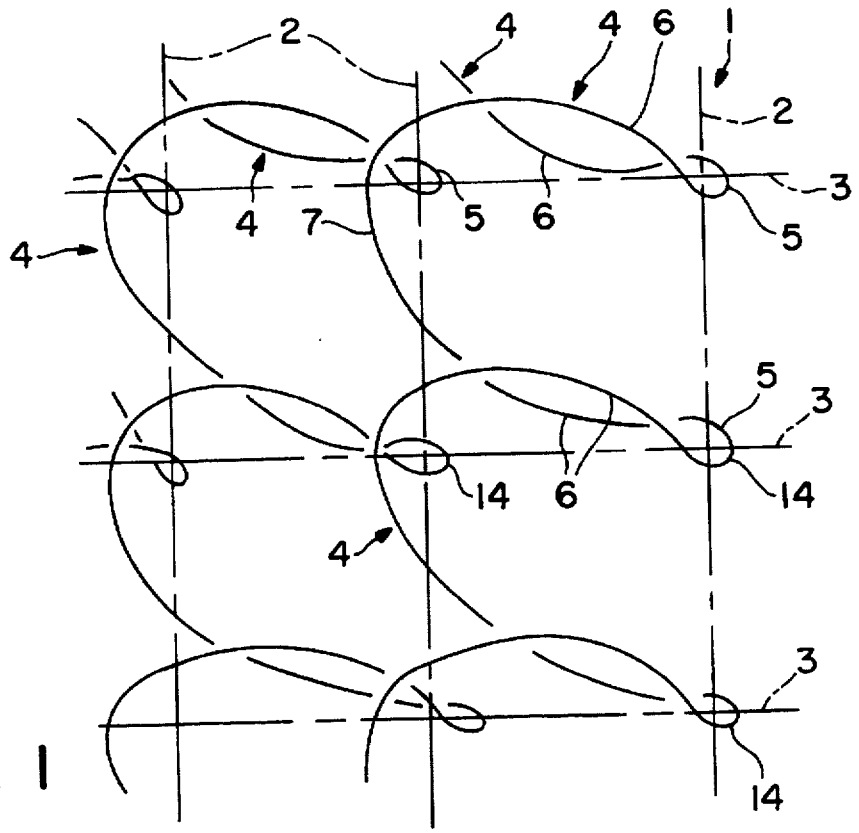
FIG. 1 is a schematic plan view showing a preferred knitting mode for making the fabric of the assembly according to the invention.

There is schematically shown in plan view in FIG. 1 a loop knitted fabric 1 constituting one of the two elements of the laminated assembly according to a preferred embodiment of the invention.

The knitted fabric 1 is of warp or weft-knitting type and it comprises, on one hand, parallel warp yarns 2 (also called wales) interleaved with weft yarns 3 (also called courses) which are parallel to each other and, an another hand, knitted free loops 4 each of the two feet 5 of which, located at the intersection of two warp and weft yarns, cooperates with the warp and weft yarns. The two legs 6 of each loop 4 extend from feet 5 and join each other, at a distance from said feet, to form the loop top or apex 7. The warp and weft yarns 2, 3 constitute a knitted structure which is very light, very open or apertured, mechanically very fragile and dimensionally instable, as stated above.

According to the invention the loops 4 have a size with respect to the warp and/or weft yarns 2, 3 such that, when considering the loops flat against the warp and weft yarns, at least one of the two legs 6 of each loop intersects or overlaps at least one warp and/or weft yarn, at a distance from the foot 5 associated to the one leg 6.

In the embodiment shown in FIG. 1, the loop 4 are directed obliquely with respect to the general directions of the warp and weft yarns and the two feet 5 of a same loop 4 are located, on one hand, on a same warp yarn 2 and, on another hand, on two adjacent weft yarns 3. Other different arrangements could be provided as to the orientations of the loops 4 and/or as to the positions of the feet 5; for example, the feet of a same loop 4 could be located on different warp yarns, for instance adjacent, and on non-adjacent weft yarns.

In the preferred embodiment shown in FIG. 1, one of the legs 6, from the associated foot 5, extends over one of the legs 6 of the next loop 4, and then over the warp yarn 2 adjacent to that which carries the feet 5 of its own loop. One of the legs 6 joins the loop top 7 which overlaps the two laterally adjacent loops 4 at a very short distance from the common foot 5 thereof. The other leg 6 from the loop top 7 overlaps the same warp yarn 2 as the first leg 6 of this same loop, and extends under one of the legs 6 of the preceding loop 4 and it joins the second foot 5. Thus, a loop 4 overlaps twice the same warp yarn 2 by its legs 6, and its loop top 7 overlaps the two laterally adjacent loops at a very short distance from the common foot 5 thereof. Moreover, as shown in FIG. 2, the loops run away from the plane formed by the warp and weft yarns 2, 3 already as from their feet 5.

Figure 2:
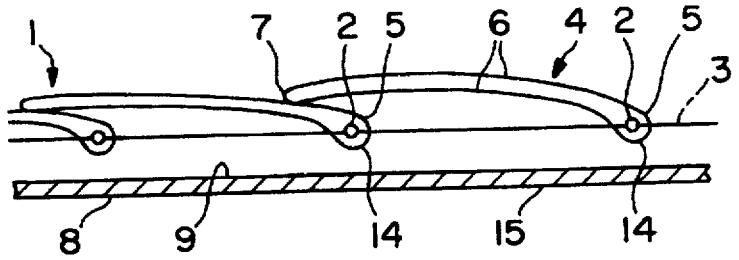
FIG. 2 is a schematic transverse cross-section exploded view of the assembly according to the invention comprising the fabric of FIG. 1.

There is schematically shown in FIG. 2, in a transverse cross-section view and in an exploded manner, a laminated assembly according to the invention. The fabric 1, which has a poor mechanical resistance and a poor dimensional stability, is intended to be adhered flat on a reinforcing support or substate 8, as indicated above, of any appropriate nature, for instance, plastic. This support can be flexible, rigid or semi-rigid and, as stated above, it can be either an intermediary support intended to be subsequently secured to an article, or this article itself. For the adherence, a film of adhesive 9, for example, is deposited on one of the faces of the support 8, said adhesive being intended to cooperate mainly with the warp yarns 2, the weft yarns 3 and that portions of the feet 5 which are located on the side of the lower or back face of the fabric 1.

During the adherence step, which is generally carried out with mechanical pressure as indicated hereinafter, the fabric 1 as a whole is caused to lie flat against the support 8 and the intermediary adhesive 9. During this step the warp yarns, the weft yarns and the lower or back portions of the feet 5 intimately cooperate with the adhesive 9, while the loop legs 6 are only partially adhered to the support 8. The loop tops 7 are protected against any adherence since they are each protected by a foot 5.

To promote adherence the loops 4 can comprise at their feet 5 and on the side of the support 8 small "counterloops" 14 intended to cooperate with the adhesive 9 to increase the contact surface between the fabric 1 and the support 8. This also reinforces the fixation of the loop feet 5 on the yarns 2, 3 and on the support 8, and therefore also the loop structure.

Thus, although the loops 4 are partially and locally adhered to the support 8, their loop tops 7 remain clear or exposed and, in use, they can freely cooperate with the complementary male hooking members, which permits to the loops 4 to retain all their self-gripping ability and properties. Moreover, upon the first separation of the two parts forming the separable fastener, the loops 4 are drawn by the male hooking members, which results by peeling effect in the separation of the legs locally adhered to the support 8 with respect to said support.

Figure 3:
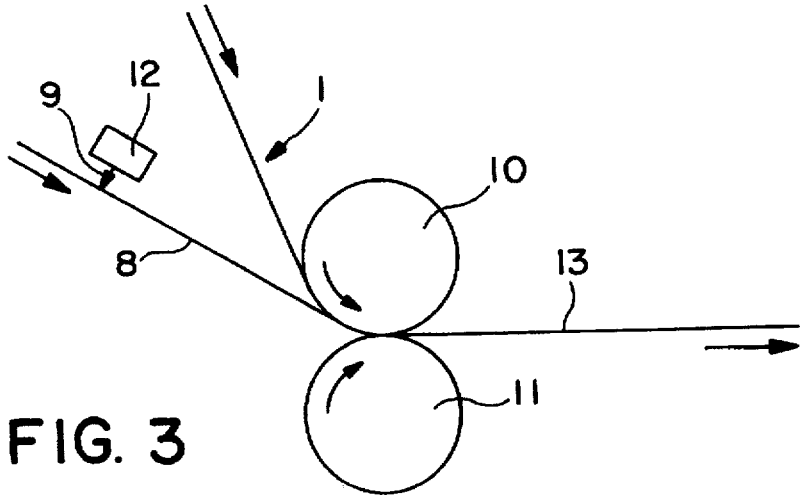
FIG. 3 schematically shows an example of a device for carrying out the flat adherence in the final step of the method according to the invention.

There is schematically shown in FIG. 3 an example of a device for carrying out the above adherence, in order to obtain the above laminated assembly in the final step of the method according to the invention, after the fabric 1 has been knitted.

This examplary device can be used in the case of a support 8 which is flexible and which is an intermediary strip or sheet, the laminated assembly being then secured to an article by any appropriate means.

This device comprises two driven pressing rollers 10, 11 which carry out the assembly of the fabric 1 and the flexible support 8. The fabric 1 is caused to cooperate first with the roller 10 which then receives the support 8 over the fabric 1. Upstream of the roller 10, the support 8 moves under a device 12 intended to apply or deposit the adhesive 9 on that face of the support 8 which faces the fabric 1. Of course, the loops 4 are located on that face of the fabric 1 which is remote from or opposite to the support 8. The fabric 1 and the support 8 superimposed on the roller 10 then jointly pass in the nip zone between the two rollers for achieving the adherence, and the laminated assembly is drawn out by any appropriate means, for instance by drawing or pulling rollers.

If the laminated assembly according to the invention is intended to be adhered to another support by the support second face 15 opposite to that which receives the fabric 1, this second face 15 can be coated with a permanent adhesive. In order to make it possible to wind the laminated assembly into a spool before the adherence step, either this adhesive receives a temporary protecting film or the loops 4 are subjected to an anti-adherence treatment, for instance by coating.

A laminated assembly including a loop fabric adhered to a support is described above. Various details of the invention may be changed without departing from its scope. Furthermore, the foregoing description of the preferred embodiment of the invention and the best mode for practicing the invention are provided for the purpose of illustration only and not for the purpose of limitation, the invention being defined by the claims.

I claim:

1. A laminated assembly forming the female, loop portion of a self-gripping hook-and-loop fastener, said assembly comprising:

(a) a light-weight, open, mechanically fragile and dimensionally unstable knitted fabric adhered in a flat condition onto a support member;

(b) said knitted fabric including interknitted warp and weft yarns, and a multitude of loops having feet cooperating with the warp and weft yarns and a pair of elongate legs extending from the feet and forming a free loop top remote from the feet;

(c) said loops being sized in relation to the spacing of the warp and weft yarns of the fabric so that at least one of the two legs of the loop intersects at least one of the warp or weft yarns in spaced-apart relation from the foot of said at least one leg;

whereby each of said loops bears on at least one warp or weft yarn to form an overlapping zone where the loop does not adhere to the support member, thus maintaining the self-gripping ability of the loops.

2. Assembly according to claim 1, wherein the top of a loop is located near the foot of another loop and overlaps same and the two legs of the loops extending from said foot.

3. Assembly according to any claim 1 or 2, wherein the loops are oblique with respect to the general directions of the warp and weft yarns.

4. Assembly according to any claim 1 or 2, wherein the two feet of a same loop are located on a same warp yarn.

5. Assembly according to any claim 1 or 2, wherein the two feet of a same loop are located on different warp yarns.

6. Assembly according to any claim 1 or 2, wherein the two feet of a same loop are located on adjacent weft yarns.

7. Assembly according to any claim 1 or 2, wherein the two feet of a same loop are located on non-adjacent weft yarns.

8. Assembly according to any claim 1 or 2, wherein, on the side of the support, the loop feet form small counterloops to increase the adherence surface and reinforce the loop fixation and structure.

9. Assembly according to any claim 1 or 2, wherein the loops are treated to be anti-adherent.

10. A method of manufacturing the laminated assembly of claim 1, and comprising the steps of:

(a) knitting said fabric where the loops are sized in relation to the spacing of the warp and weft yarns of the fabric so that at least one of the two legs of the loop intersects at least one of the warp or weft yarns in spaced-apart relation from the foot of said at least one leg;

(b) applying an adhesive to said support member; and (c) adhering said fabric in a flat condition to said support member.

* * * * *